US006521052B2

(12) United States Patent
Park et al.

(10) Patent No.: US 6,521,052 B2
(45) Date of Patent: Feb. 18, 2003

(54) SURFACE TREATMENT

(75) Inventors: Cheol Park, Grafton, VA (US); Sharon E. Lowther, Hampton, VA (US); Terry L. St. Clair, Poquoson, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/780,132

(22) Filed: Feb. 9, 2001

(65) Prior Publication Data

US 2002/0004102 A1 Jan. 10, 2002

Related U.S. Application Data

(60) Provisional application No. 60/181,514, filed on Feb. 10, 2000.

(51) Int. Cl.[7] ..... C23C 22/00

(52) U.S. Cl. ..... 148/279; 148/281; 148/282; 427/419.2; 216/101; 216/103; 216/106; 216/108

(58) Field of Search ..... 148/275, 279, 148/281, 282; 427/419.2; 216/101, 103, 106, 108

(56) References Cited

U.S. PATENT DOCUMENTS 3,802,973 A * 4/1974 Smith ..... 156/22

FOREIGN PATENT DOCUMENTS

EP 0 896 502 A1 * 2/1999

* cited by examiner

*Primary Examiner*—John Sheehan
*Assistant Examiner*—Andrew L. Oltmans
(74) *Attorney, Agent, or Firm*—Robin W. Edwards; Patrick F. Roughen, Jr.

(57) ABSTRACT

A simple surface treatment process is provided which offers a high performance surface for a variety of applications at low cost. This novel surface treatment, which is particularly useful for Ti-6Al-4V alloys, is achieved by forming oxides on the surface with a two-step chemical process and without mechanical abrasion. First, after solvent degreasing, sulfuric acid is used to generate a fresh titanium surface. Next, an alkaline perborate solution is used to form an oxide on the surface. This acid-followed-by-base treatment is cost effective and relatively safe to use in commercial applications. In addition, it is chromium-free, and has been successfully used with a sol-gel coating to afford a strong adhesive bond that exhibits excellent durability after the bonded specimens have been subjected to a harsh 72 hour water boil immersion. Phenylethynyl containing adhesives were used to evaluate this surface treatment with a novel coupling agent containing both trialkoxysilane and phenylethynyl groups.

8 Claims, 16 Drawing Sheets

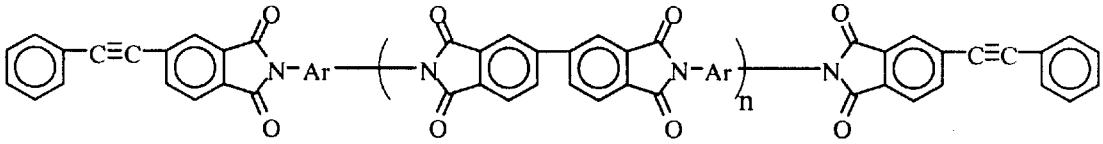
PETI-5
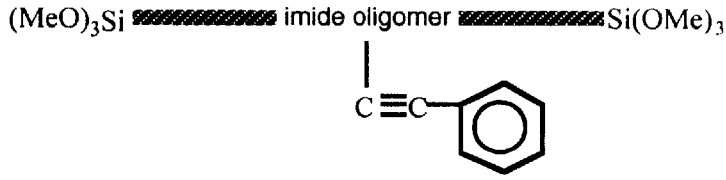
Aromatic phenylethynyl imide silane (APEIS)
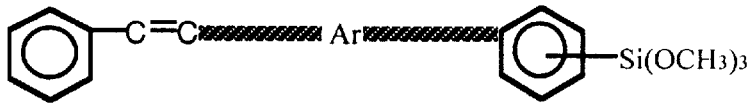
Pendent phenylethynyl imide disilane (PPEIDS)
FIG. 1

FIGS. 15a-d

SURFACE TREATMENT

CLAIM OF BENEFIT OF PROVISIONAL APPLICATION

Pursuant to 35 U.S.C. §119, the benefit of priority from provisional application 60/181,514, with a filing date of Feb. 10, 2000, is claimed for this non-provisional application.

ORIGIN OF INVENTION

The invention described herein was jointly made by an employee of the National Research Council and employees of the United States Government and may be manufactured and used by or for the Government for governmental purposes without payment of any royalties thereon or therefor.

FIELD OF THE INVENTION

This invention relates generally to surface treatments for metals, and more specifically to surface treatments for titanium alloys.

BACKGROUND OF THE INVENTION

High-speed commercial aircraft require a surface treatment for titanium (Ti) alloys that is both environmentally safe and durable under the conditions of supersonic flight. A number of pretreatment procedures for Ti alloys requiring multiple stages have been developed to produce a stable surface. These stages include degreasing, mechanical abrasion, chemical etching, and electrochemical anodizing. These treatments exhibit significant variations in their long-term stability, and the benefits of each step in these processes still remain unclear. Moreover, these multistep processes are expensive and time consuming and, because of the multiple steps involved, are prone to error. In addition, the chromium compounds often used in these chemical treatments are detrimental to the environment.

Recently, a chromium-free surface treatment for Ti alloy has been reported [F. L. Keohan and B. J. Hecox, Proceedings of the 21st Annual Meeting of the Adhesion Society (Savannah, Ga., 1998), p. 60], although this treatment is not designed for high temperature applications. Other chromium-free surface treatments for Ti alloys include those described in U.S. Pat. No. 5,939,197 (Blohowiak et al.), U.S. Pat. No. 5,869,141 (Blohowiak et al.), U.S. Pat. No. 5,849,140 (Blohowiak et al.) and U.S. Pat. No. 5,814,137 (Blohowiak et al.).

Some metal treatment processes entail the use of hydrogen peroxide to oxidize the surface of the metal. However, the use of hydrogen peroxide is undesirable because of its attendant fire and explosion hazards. In particular, hydrogen peroxide provides oxygen very rapidly to facilitate or initiate burning of surrounding combustibles.

A further drawback of many metal treatments is that they degrade after exposure to hot, humid environments of the type encountered by many aircraft. Thus, the performance of such treatments, while initially satisfactory, is seen to degrade over time in the field.

There is thus a need in the art for a simplified surface treatment for titanium alloys and other metals. There is also a need in the art for a chromium-free surface treatment for titanium alloys and other metals which can be used in high temperature applications. There is further a need in the art for a surface treatment for titanium and other metals which exhibits good long-term stability. There is also a need in the art for metal treatments that can withstand hot, humid environments without significant degradation.

These and other needs are met by the present invention, as hereinafter described.

SUMMARY OF THE INVENTION

In one aspect, the present invention relates to a method for treating the surfaces of metals, such as those comprising titanium alloys, and to the surfaces so treated. In accordance with the method, oxides are formed on the surface of the alloy using a two-step chemical process featuring the application of an acid followed by a base or oxidizing agent, and without mechanical abrasion. The method results in a high performance surface for a variety of applications. The method of the present invention is cost effective and relatively safe to use in a commercial application. In addition, it is chromium-free, and can be successfully used with a sol-gel coating to afford a strong adhesive bond after exposure to hot-wet environments.

The metal treatments of the present invention exhibit excellent durability upon exposure to hot, wet environments with approximately 90% retention of initial strengths. An oxide layer developed by this base treatment can be controlled by time, temperature, and concentration. The morphology and chemical composition of the oxide layer was investigated and revealed the formation of metal oxide compounds on the treated surface.

In another aspect, the present invention relates to a method for controlling the surface energy and morphology of a metal substrate. In accordance with the method, the substrate, which may comprise, for example, a titanium alloy, is treated with an acid followed by a base. The base treatment time and/or temperature are controlled so as to create a desirable surface for bonding.

The method for treating metal substrates in accordance with the present invention has a number of notable features and attributes. It provides a simple acid-base surface treatment process that does not require mechanical abrasion or the use of chromium compounds, and therefore achieves an environmentally safe and stable metal surface for bonding. The surface treatment process comprises only a two-step chemical process, namely, acid etching of the substrate (e.g., with sulfuric acid) followed by surface oxidation of the substrate (e.g., with an alkaline perborate treatment as the oxidizing agent). The acid etching is used to generate a fresh metal surface and the base treatment is used to form a stable oxide on the surface. Other features and attributes include:

1. The process is simple and cost effective because it can be achieved using a simple two-step chemical process. Most of existing procedures for surface pretreatment require multiple stages such as degreasing, mechanical abrasion, multiple chemical etching, electrochemical anodizing, and so on.

2. The process can be applied to any complex substrate, including thin metal sheet and honeycomb structures, since the conventional mechanical abrasion procedure can be replaced by sulfuric acid etching.

3. The process is chromium-free, and therefore much more environmentally friendly than many conventional treatment processes.

4. The process is safe and convenient to use, since perborate powder is used as an oxidizing agent (e.g., instead of hydrogen peroxide) to generate a fresh oxide layer.

5. The process can be easily controlled by variation in solution concentration, treatment time and/or temperature.

6. The process has been successfully used with a sol-gel coating to afford a strong adhesive bond, which exhibits excellent durability even after the bonded specimens are subjected to a harsh 72 hour water-boil or 2000 hour exposure at 177° C.

7. The surface energy and morphology can be efficiently controlled by the base treatment time and temperature to create a desirable surface for bonding.

8. The process can be applied to any solid substrate titanium alloy, stainless steel, aluminum alloy, glass, copper, and so on to promote bonding in the areas of paint, coating, automotive, and aircraft applications. Degrees of acid etching and base oxidization can be readily adjusted depending on the solid substrate.

9. The process can be applied in the electronic industry as a safer treatment for silicon wafers.

10. The process can be applied to inorganic inclusions (reinforcing particles, fibers, fabrics, and platelets) in composites to create a fresh oxide surface before surface modification (sizing).

BRIEF DESCRIPTION OF THE FIGURES

FIG. 1 is a schematic drawing of the chemical structures of the ingredients used in the sol-gel solutions of the present invention;

DETAILED DESCRIPTION OF THE PREFERRED EMBODIMENTS

Figure 2:
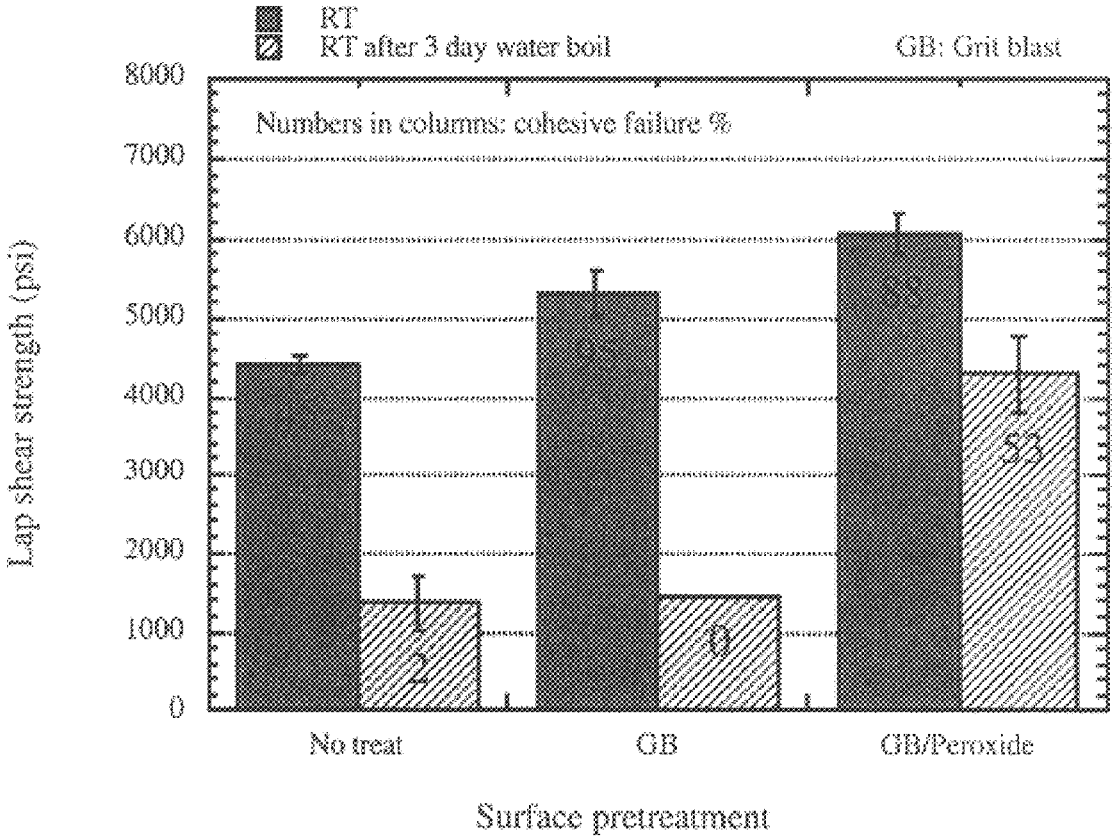
FIG. 2 is a graph of lap shear strength as a function of surface pretreatment for various surface pretreatments using a 2% PPEIDS sol-gel solution.

In accordance with the present invention, a simple surface treatment process is provided which offers a high performance surface for a variety of applications. This novel surface treatment, which is particularly suitable for Ti alloys, is achieved by forming oxides on the surface with a two-step chemical process without mechanical abrasion. This sequence of treatment with an acid followed by treatment with a base was designed to be cost effective and relatively safe to use in commercial applications. In addition, it is chromium-free, and has been successfully used with a sol-gel coating to afford a strong adhesive bond after exposure to hot-wet environments.

Phenylethynyl containing adhesives were used to evaluate this surface treatment with sol-gel solutions made of novel imide silanes. Oxide layers developed by this process were controlled by immersion time and temperature and solution concentration. The surface treatment for various metal substrates was evaluated as a function of time and temperature of the treatment. Contact angles and surface energies of the treated substrates were measured by a goniometer and atomic force microscopy (AFM). The stability of the chemically treated surface was evaluated as a function of elapsed time after treatment. The morphology and chemical composition of the oxide layers were investigated using optical and scanning electron microscopy (SEM) with EDX and X-ray mapping modes and Auger electron spectroscopy (AES). Bond strengths made with this new treatment were evaluated using single lap shear tests.

EXAMPLES

The following illustrates the treatment of metal substrates in accordance with the methodology of the present invention.

The adherends of primary interest were Titanium 6Al-4V (Ti-6-4) alloys. There are two types: shiny and dark Ti-6 4. The former is cleaner and processed with shorter annealing time (15 min at 788° C.) than the latter (45 min at 788° C.). Other metals studied included 2024-T3 aluminum alloy (Al) and PH17-7 stainless steel (S-steel).

Acetone and methanol were used as cleaning solvents to degrease the metals. Alumina grit blast and alkaline peroxide solution (1M $H_2O_2$/0.5M NaOH) were used to prepare reference specimens. The materials for the new acid-base process were sulfuric acid solution (9M $H_2SO_4$) and alkaline perborate solution (0.5M $NaBO_3 \cdot H_2O$/1M NaOH) as the acid etchant and oxidizing agent, respectively. First, after solvent degreasing, the sulfuric acid was used to generate a fresh surface. Next, an alkaline perborate solution was used to form an oxide on the surface. Ultrasonic washing in distilled water was used between each treatment, and then dried for 5 min at 100° C.

The alkaline perborate solution was prepared as follows.

1000 ml alkaline perborate solution (0.5M $NaBO_3 \cdot H_2O$/1M NaOH)

A fresh alkaline perborate solution was prepared for each experiment just before treatment. 910 ml distilled water in a 2 l flask was heated to 60° C., and then 50 g of white perborate hydrate powder ($NaBO_3 \cdot H_2O$) was added with stirring to form a clear solution. The perborate hydrate eventually liberates hydrogen peroxide at temperatures up to 60° C. The solution was cooled to room temperature (RT) and 40 g of NaOH was added to the perborate solution to dissolve exothermically with stirring to produce an alkaline perborate solution. The heated solution was cooled to room temperature and the Ti alloy panels were treated at either room temperature or 60° C.

Immersion time and temperature for the acid-base treatment were controlled to create various surface morphologies for each metal substrate. An acid treatment of 10 min (or 30 min) and a base treatment of 10 min at room temperature (RT), abbreviated as A10B10RT, was chosen as the standard acid-base treatment condition for lap shear strength test. A PasaJell 107 treatment after an alumina grit-blasting was employed for comparison. The sequence of the acid and base treatment was also varied, for examples, acid-base and base-acid-base sequences were tried.

Various sol-gel solutions were prepared prior to acid-base treatment using a phenylethynyl terminated imide oligomer (PETI-5, Imitec, Inc.) and novel phenylethynyl imide silanes such as aromatic phenylethynyl imide silane (APEIS) and pendent phenylethynyl imide oligomeric disilane (PPEIDS). Tetraethoxysilane (TEOS) was used as an inorganic precursor with the organic solutions. PETI-5/APEIS/TEOS, PPEIDS/TEOS, and PPEIDS were used as the sol-gel solutions. Other suitable phenylethynyl-containing materials and treatments that may be applied to metal substrates prepared in accordance with the present invention include those described in U.S. Ser. No. 09/783,578, entitled "Phenylethynyl-Containing Imide Silanes", and filed on even date herewith, now abandoned, which is hereby incorporated by reference in its entirety and [C. Park, S. E. Lowther, J. G. Smith, Jr., J. W. Connell, P. M. Hergenrother, T. L. St. Clair, "Polyimide-silica hybrids containing novel phenylethynyl imide silanes as coupling agents for surface-treated titanium alloy", *International J. of Adhesion & Adhesive,* 20, Elsevier Science Ltd. (2000), pp. 457–565], which is hereby incorporated by reference in its entirety.

Schematic chemical structures of the ingredients of the sol-gel solutions are shown in FIG. 1. A sol-gel solution was applied to the pretreated metals for 3 min immediately after drying them in an oven at 100° C. for 10 min. The metals coated with the sol-gel solution were placed in the oven at 110 and 220° C. for 30 min each.

The treated metal substrates were examined using a goniometer (Rame-Hart, Inc.) with the contact angles of the treated surfaces measured as a function of time. The surface energy measurement of the treated metal substrates was performed with atomic force microscopy (AFM) by measuring adhesive forces using a METRIS 2000 SPM (Burleigh Instruments). A silicon tipped cantilever was used to measure the adhesive force between the silicon tip and the treated substrate form force-distance curves in the contact mode. The Single lap shear specimens were bonded at 371° C. under 50 psi for an hour in an autoclave using a phenylethynyl containing imide adhesive tape (FM-x5, Cytec Fiberite). Bond strengths of the lap shear specimens were tested according to ASTM D1002. An optical microscope (Olympus BH-2), SEM (JMS-6400)), and AES (610 scanning Auger system) were used to analyze the surface morphology and chemical composition. Polished sections of the Ti-6-4 alloys in an epoxy molding resin were used for EDX and X-ray mapping study using the SEM.

IMPORTANT RESULTS

Effect of acid-base surface treatment

FIG. 2 shows lap shear strengths for the specimens treated with the alkaline peroxide (RT for 10 min) subsequent to the mechanical abrasion. While the RT strength with only grit-blast did not exhibit resistance in the hot-wet environment, those with additional alkaline peroxide treatment raised both initial and hot-wet strengths significantly. This demonstrates the efficacy of using an oxidizing agent (alkaline peroxide) to develop a durable oxide layer against hostile environments. Although mechanical abrasion is desirable to produce a rough and fresh surface, there is a limit for this application to complex substrates, so that mechanical abrasion was replaced by sulfuric acid etching. In addition, alkaline peroxide was replaced by alkaline perborate to produce a safe and stable oxidizing agent. Perborate, eventually liberates hydrogen peroxide at temperatures up to 60° C.

Figure 3:
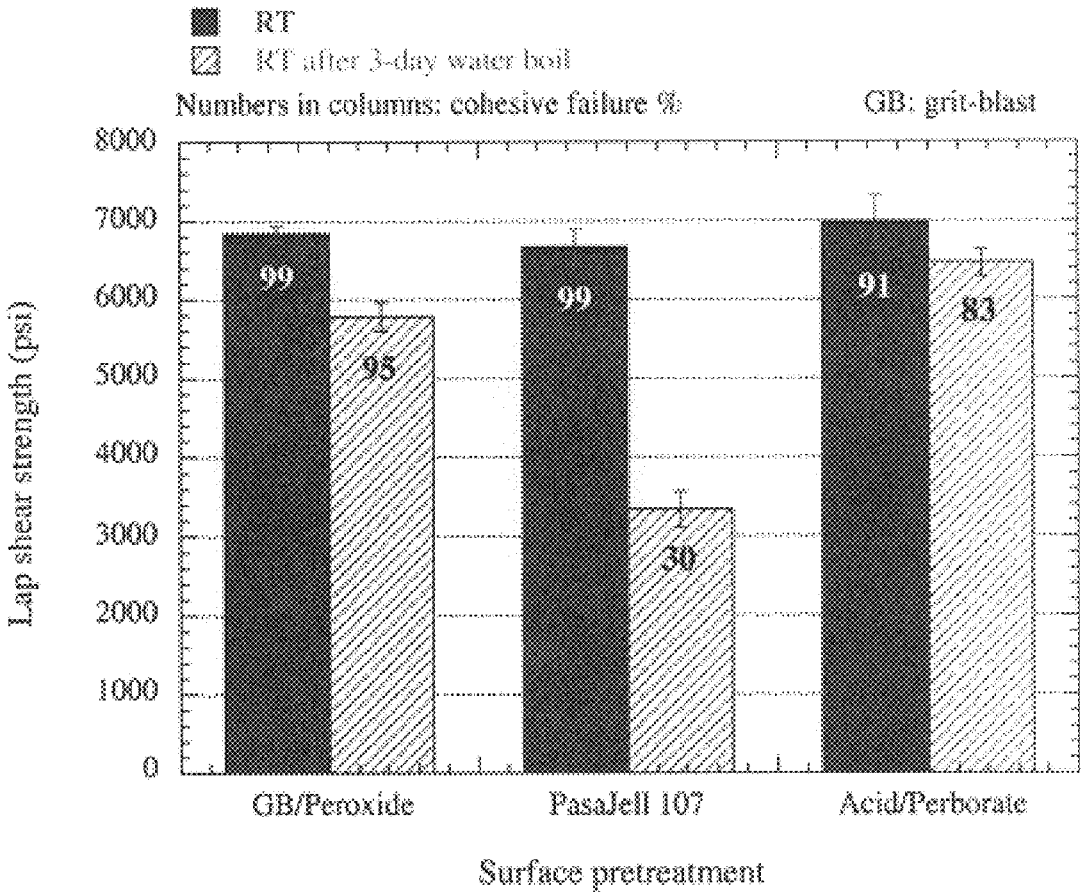
FIG. 3 is a graph of lap shear strength as a function of surface pretreatment for grit-blast/peroxide and acid/perborate using 15% PETI-5·APEIS/TEOS.
Figure 13:
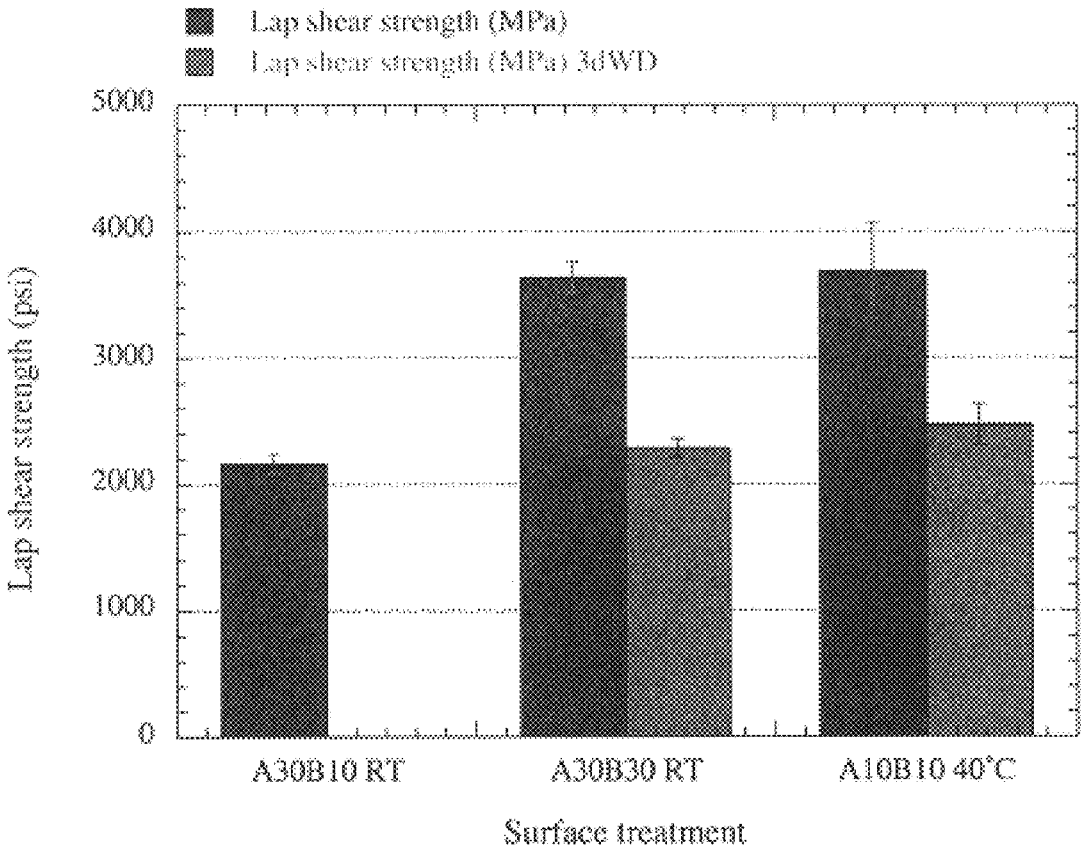
FIG. 13 is a graph of lap shear strength as a function of base treatment for stainless steel.

Lap shear strengths with grit-blast/Pasa-Jell, grit-blast/alkaline peroxide, and sulfuric acid/alkaline perborate treatments are compared in FIGS. 3 and 13. The strengths are almost the same for all the treatments, but the grit-blast/alkaline peroxide and new acid-base treatments exhibit much better resistance in the hot-wet environment. Lap shear strengths for grit-blast/Pasa-Jell treatment with a phenylethynyl containing adhesive (PETI-5) have also been reported, which were 7110 psi RT strength and 5950 psi RT strength after a 3-day water-boil [B. Jensen, R. G. Bryant, J. G. Smith Jr., and P. M. Hergenrother, J. Adhesion 54, 57 (1995)].

Figure 4:
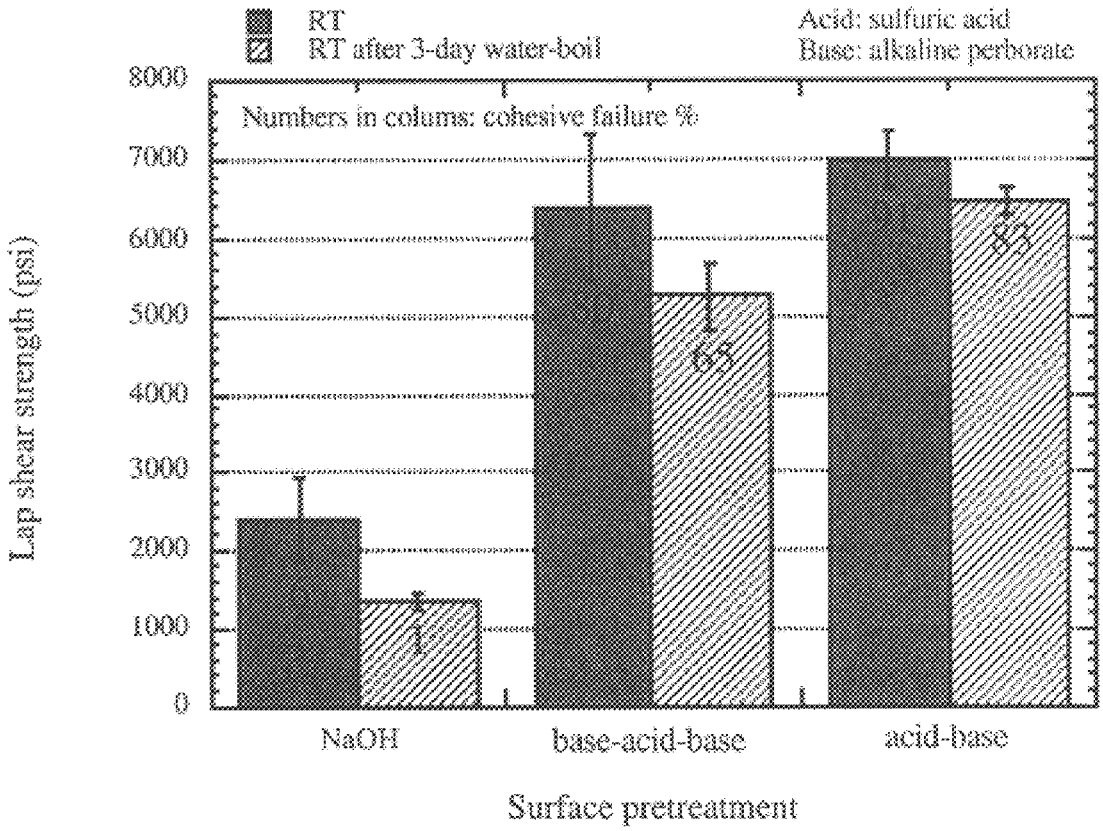
FIG. 4 is a graph of lap shear strength as a function of surface pretreatment for various alkaline treatments.

FIG. 4 shows lap shear strengths for various alkaline treatments, indicating that the acid-base is more effective than the base-acid-base sequence. The specimens treated with only NaOH are also shown for comparison. Base treatment before acid etching probably reduces the acid etching effect due to neutralization between acid and base.

Concentration effect of sol-gel coating

Figure 5:
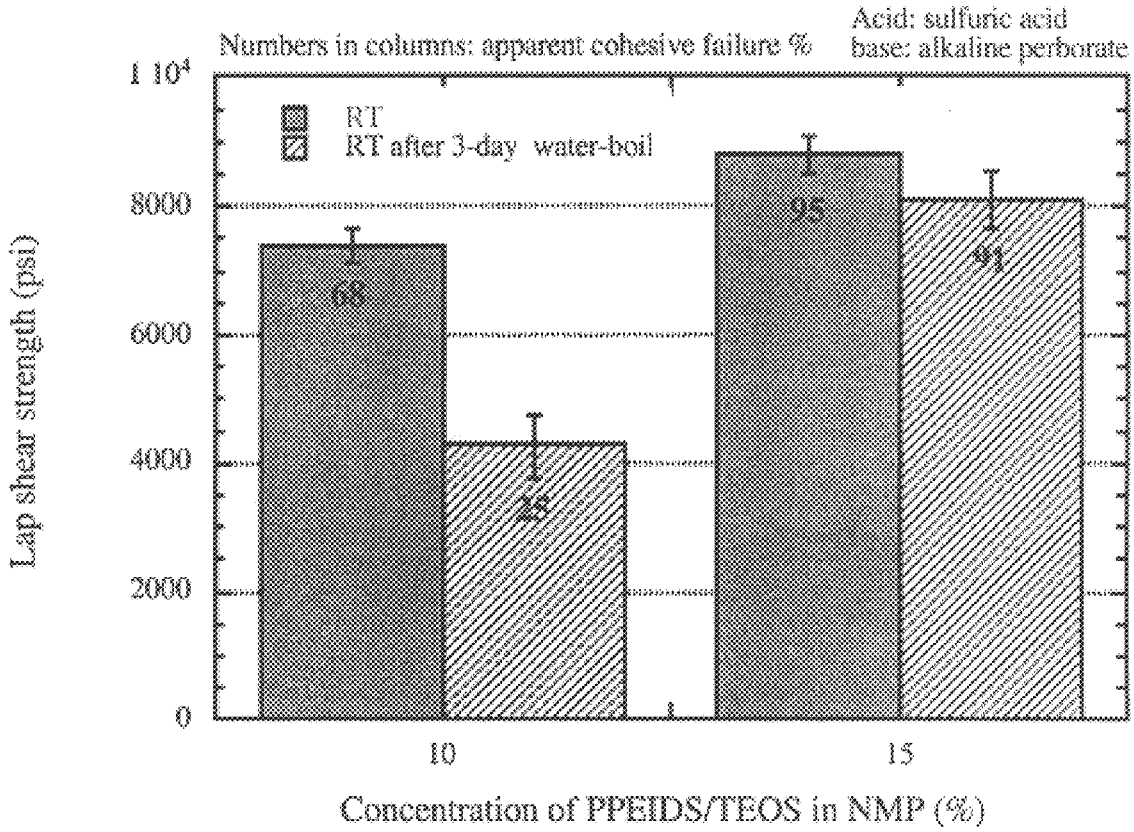
FIG. 5 is a graph of lap shear strength as a function of concentration for specimens treated with 10 and 15% PPEIDS/TEOS solutions.

FIG. 5 shows the lap shear strength data for PPEIDS/TEOS specimens with strengths at RT and RT after a 3-day water-boil increasing with the concentration of the solution (i.e. sol-gel layer thickness). Significant improvements in tensile shear strengths were found at RT after a 3-day water boil. This increase presumably arises from a priming effect due to thicker coating layer to produce a flat sol-gel surface for bonding since the oxide layer developed by base treatment tends to be uneven. No primer has been used in this study. The same trend was observed with the data from the PETI 5/APEIS/TEOS specimens.

Evaluation of surface developed by acid-base surface treatment

Ti-6-4 alloy specimens subjected to the acid-base treatment with a variation in time and temperature were analyzed using microscopy. Acid etching was fairly effective in degreasing tacky contaminants, and the degree of degreasing was proportional to etching time according to optical microscopy examination, which can be evaluated using contact angle and surface energy measurements. Base treatment as an oxidizing agent was very efficient in developing a fresh oxide layer. The thickness of the oxide layer increased with both time and temperature. Platelets (<10 $\mu$m) with a broad size distribution were developed during the base treatment. The shape and size of the platelets were most likely dependent on the processing conditions of the Ti alloys such as heat treatment, rolling, and cleaning. The shiny Ti-6-4 treated with the alkaline perborate at RT for 10 min produced what appeared to be a flat layer of the platelets with the periphery being more angular compared to the dark Ti-6-4 that formed thicker and less flat layer with more round platelets. The role of the shape, size, and thickness of the platelets remains unknown. A surface having a thick oxide layer usually affords a thinner solution coating and poorer wetting compared to a nominal mono-layer oxide surface. This thicker oxide layer results in lower strengths. Essentially, the same trend was observed with temperature variation. Higher temperature (60° C.) tended to develop a non-uniform, multi-layer oxide because perborate dissociates very rapidly into hydrogen peroxide at 60° C. to become more reactive than RT. A 60° C. treatment of the dark Ti-6-4 afforded 4254 psi RT strength and 4034 psi RT strength after a 3-day water-boil. This was lower strength than the shiny (cleaner) Ti-6-4. Therefore, 10 min base treatment at RT was selected as a standard condition for Ti-6-4 alloy. Immersion time and temperature for acid-base treatment should be adjusted depending on metal substrate, for instance, longer acid-base treatment is required for stainless steel to achieve robust and stable bond strength.

Figure 6:
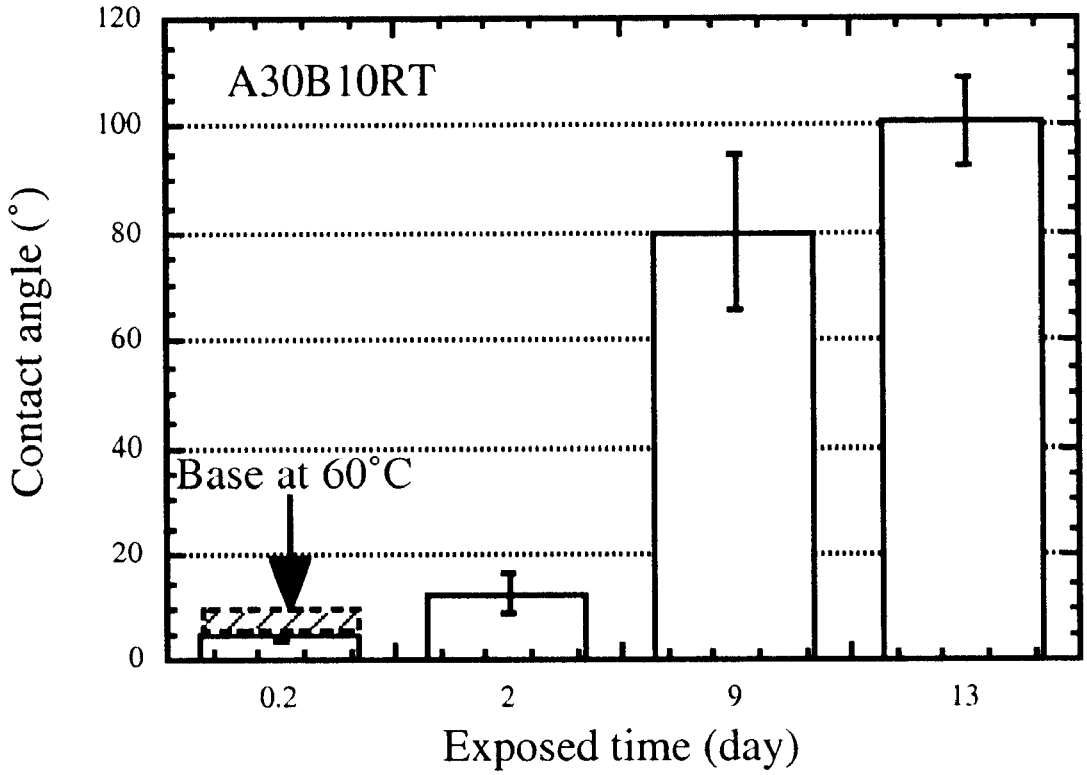
FIG. 6 is a graph of contact angle as a function of elapsed time after base treatment for Ti-6-4.

An oxidized metal surface is often susceptible to moisture and carbon contamination, resulting in lowering the surface energy and wettability with time. Therefore, the stability of the acid-base treated surface was evaluated by measuring contact angles (advancing contact angles to water) as a function of time. The treated substrates were preserved in a desiccator until measurement. As seen in FIG. 6, contact angles increased with the increase of the elapsed time after treatment. The initial contact angle was about 5° and increased to 13° after 2 days, and went up to 101° after 13 days. Thus, the treated surface should be protected with a primer until bonded with an adhesive. For the same amount of immersion time, the base tends to create a thicker oxide layer with higher contact angles at higher temperatures (hatched column, 60° C.).

Figure 7:
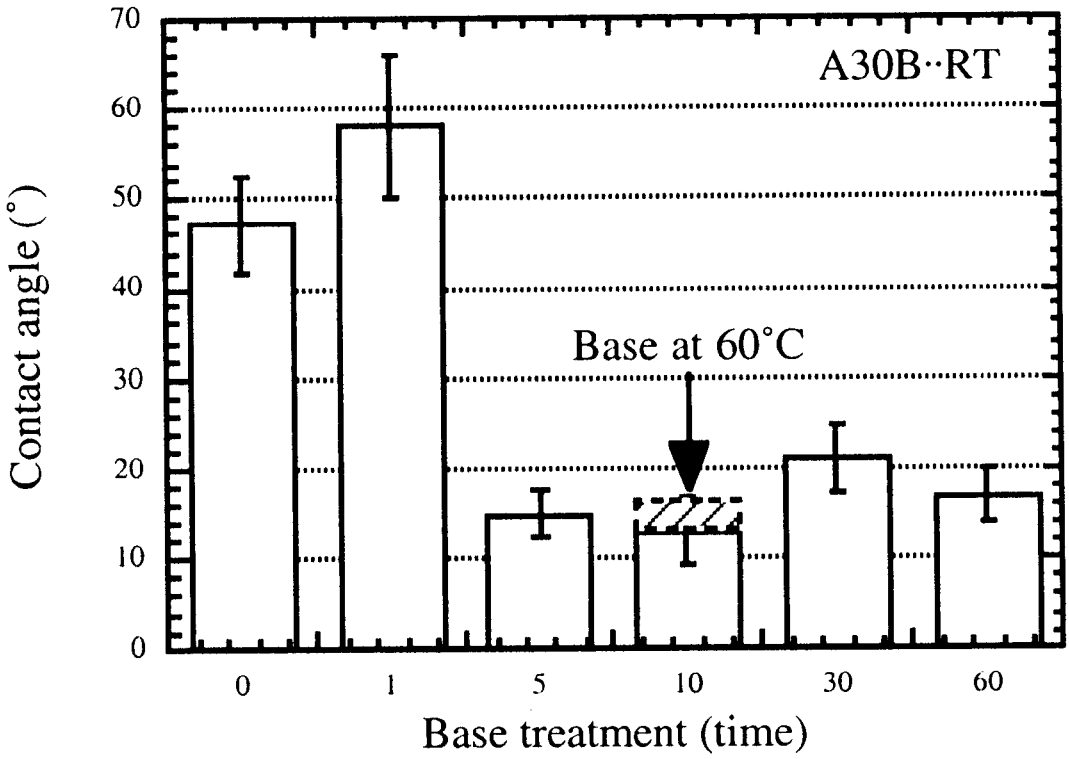
FIG. 7 is a graph of contact angle as a function of elapsed time after base treatment for Ti-6-4 measured after 2 days.
Figure 8:
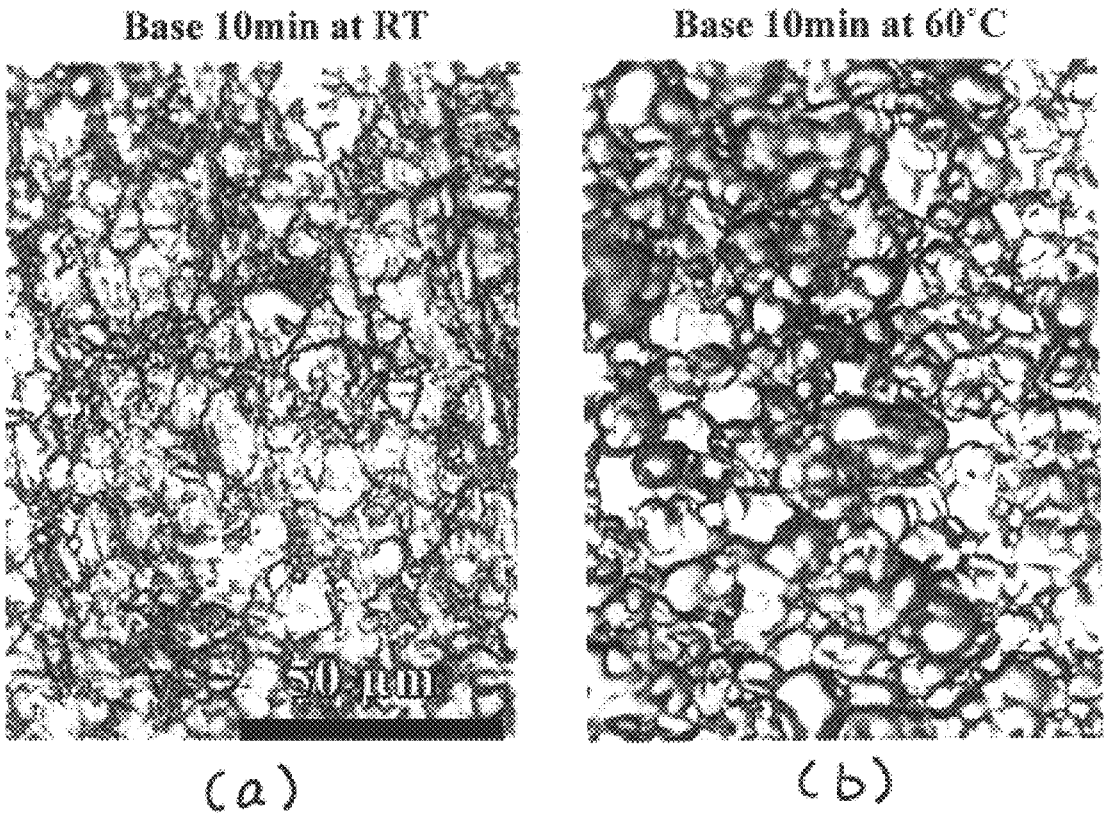
FIGS. 8*a*–8*b* are optical micrographs of acid-base treated Ti-6-4 surfaces.

Sulfuric acid was employed to generate a fresh titanium surface, but it is prone to be unstable because of the high reactivity of the titanium. A subsequent base treatment usually provides a relatively more stable oxide layer. The surface energy of the oxide layer can change dramatically as a function of base treatment time and temperature. FIG. 7 shows that the contact angle slightly increased at 1 min and decreased with treatment time, and was lowest at 10 min. This contact angle change appears to have resulted from the surface morphology as a function of base treatment time and temperature. FIG. 8 shows optical micrographs of Ti-6-4 treated with the base at different temperatures. At room temperature, the flat, angular grains with a relatively narrow size distribution begin to appear discernible after 5 min and grow with time. At higher temperatures, more round grains with a broader size distribution tend to appear. The thickness of the oxide layer increased with increasing the treatment time and temperature. Therefore, the surface energy and morphology can be controlled by the base treatment time and temperature to create a desirable surface for bonding.

Figure 9:
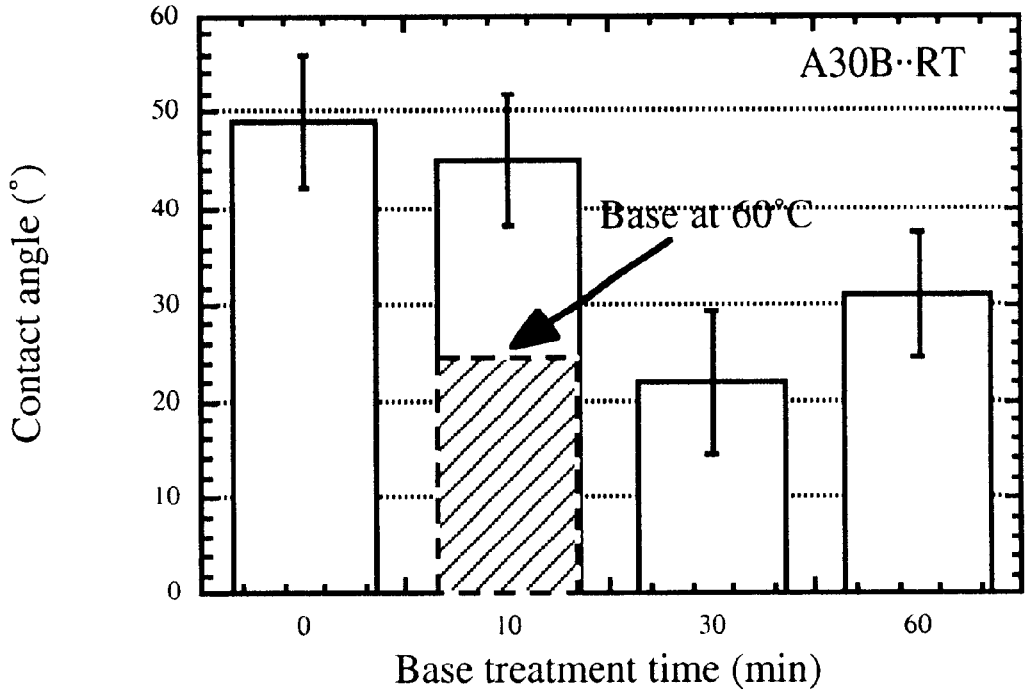
FIG. 9 is a graph of contact angle as a function of base treatment time for steel measured within 4 hours.

Degrees of acid etching and base oxidization depend on the metal substrate as well as the treatment time and temperature. Thus, the acid-base treatment condition should be evaluated with respect to the metal substrate. For example, a longer and higher temperature treatment is required for the steel substrate to create a high-energy surface as shown in FIG. 9. The contact angle was lowest at 30 min, and treatment at 60° C. generated a surface with lower surface energy than RT.

Figure 10:
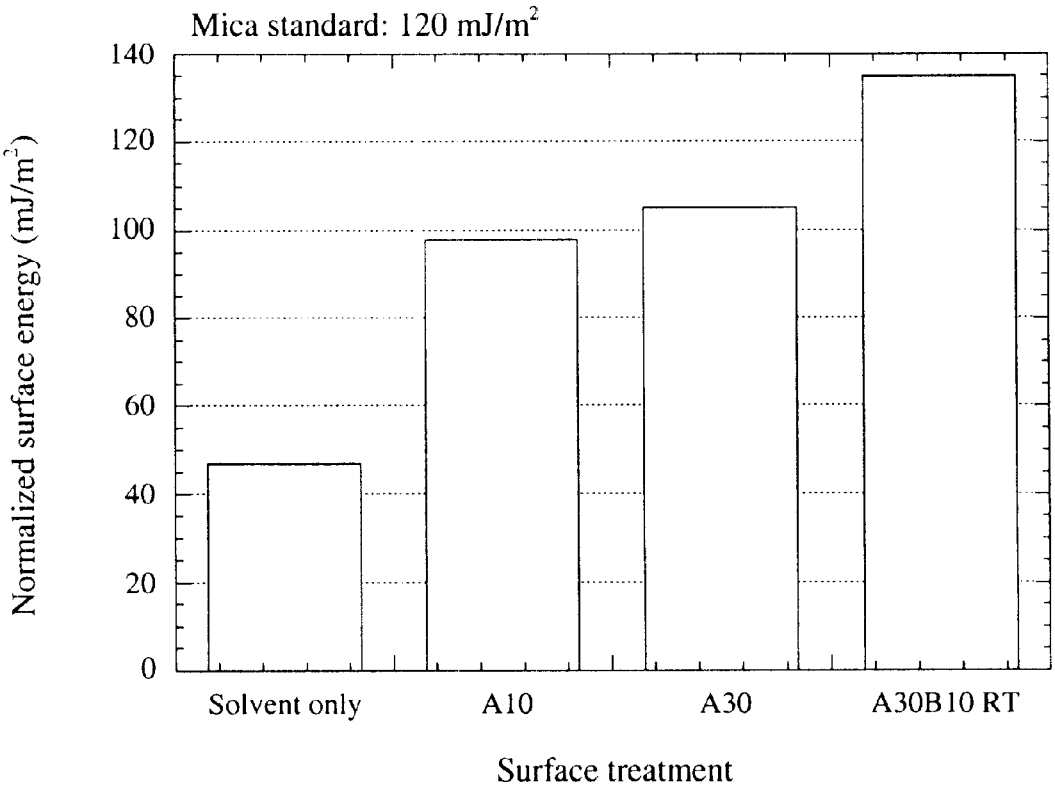
FIG. 10 is a graph of the normalized surface energy of a substrate after various surface treatments.
Figure 11:
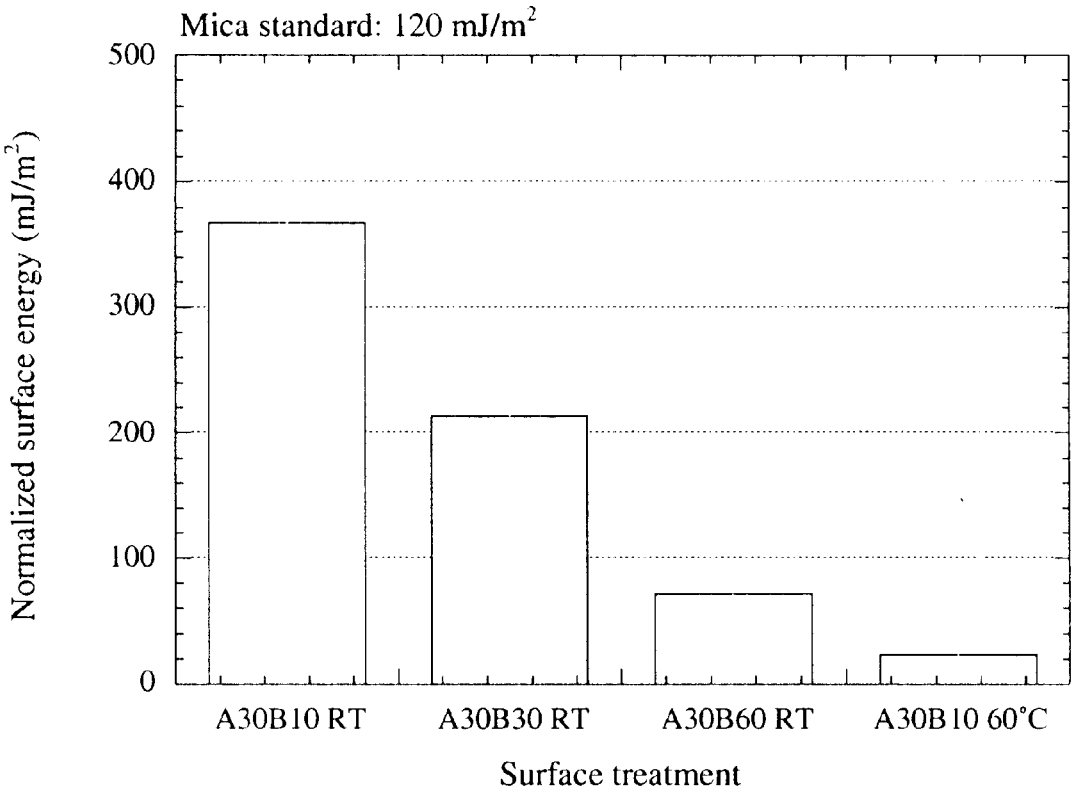
FIG. 11 is a graph of the normalized surface energy of a substrate after various surface treatments.

Surface energy of a substrate was able to be evaluated using atomic force microscopy (AFM) using a silicon tip cantilever by measuring adhesive force between the tip and metal substrate. Mica standard was used as a reference with the value of 120 $mJ/m^2$. The surface energy almost doubled after acid etching 10 min and increased with immersion time of acid etching as seen in FIG. 10. Further increase of surface energy was achieved after the subsequent base treatment. Surface energy decreased when treated with the base at an elevated temperature, 60° C. or extended period of immersion time, 60 min as shown in FIG. 11. The surface energy appeared to decrease with time of exposure in air after treatment. These results are consistent with the contact angle measurement results.

The efficacy of the acid-base treatment on the bond strength was determined on lap shear specimens for the treated metals (Table 1). The acid-base treatment exhibited good strengths for both PETI-5 and PETI-5/APEIS/TEOS sol-gel primers for Ti-6-4. The strength of Ti-6-4 remained statistically constant with the increase of treatment time at RT after 10 min. Higher temperature treatment rendered lower strength for Ti-6-4, but higher strength for the steel. Thus, the bond strength showed a good correlation with the contact angle (surface energy), and higher strength was always obtained from lower contact angle or higher surface energy surfaces for both Ti-6-4 and stainless steel.

Long-term stability at an elevated temperature (177° C.)

Lap shear strengths of specimens treated with 15% PETI-5/APEIS/TEOS were measured at RT after aging unstressed specimens at 177° C. in flowing air (Table 2). They exhibited good strength retention even after 2000 hrs aging.

Application of acid-base surface treatment for various solid substrates

Figure 12:
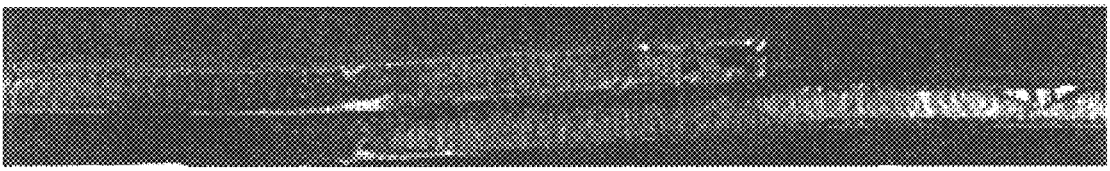
FIG. 12 is a photograph of a tested aluminum lap shear specimen showing a deformed joint after metal failure.

The acid-base pretreatment was also employed for other metals including aluminum alloy (2024-T3) and stainless steel (PH17-7) using the 15% PETI-5·APEIS/TEOS primer/coupling agent. Single lap shear specimens were prepared and tested. An example of the tested aluminum specimen is shown in FIG. 12. Failure occurred in the metal rather than in the joint, giving 3314 psi with significant, permanent joint deformation, and the adhesive bond remained healthy even after significant deformation during failure. Therefore, the actual lap shear strength of the aluminum alloy is expected to be higher than what was measured. The lap shear strengths of the stainless steel are shown in FIG. 13 as a function of base treatment time and temperature. Longer time (30 min) and higher temperature (40° C.) showed better strengths. Different metals appeared to have different optimum conditions for surface treatment time and concentration.

Chemical analysis of oxide layer developed by acid-base treatment

Figure 14:
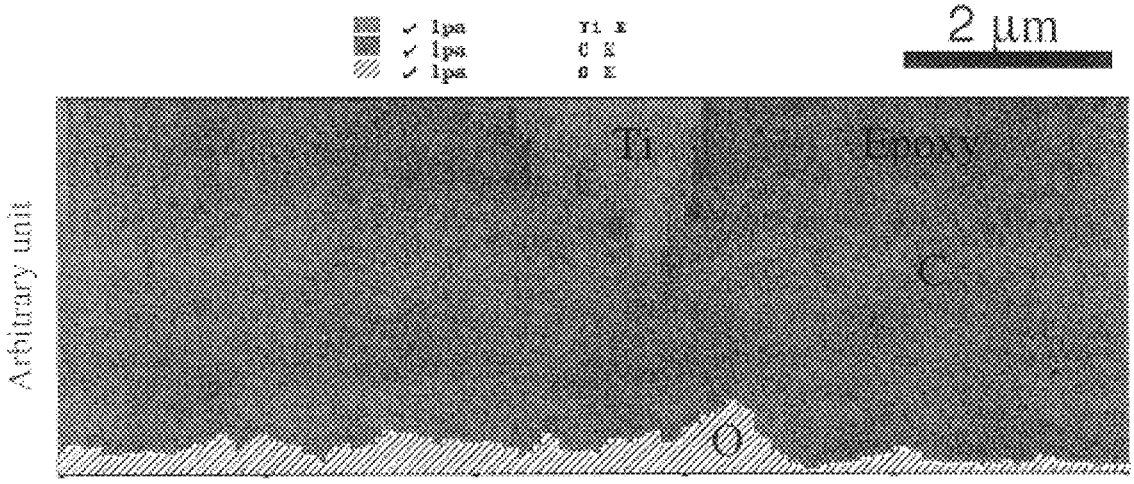
FIG. 14 is an EDX line map of Ti-6-4 alloy treated with the acid-base process of the present invention for 10 minutes at room temperature.
Figure 15:
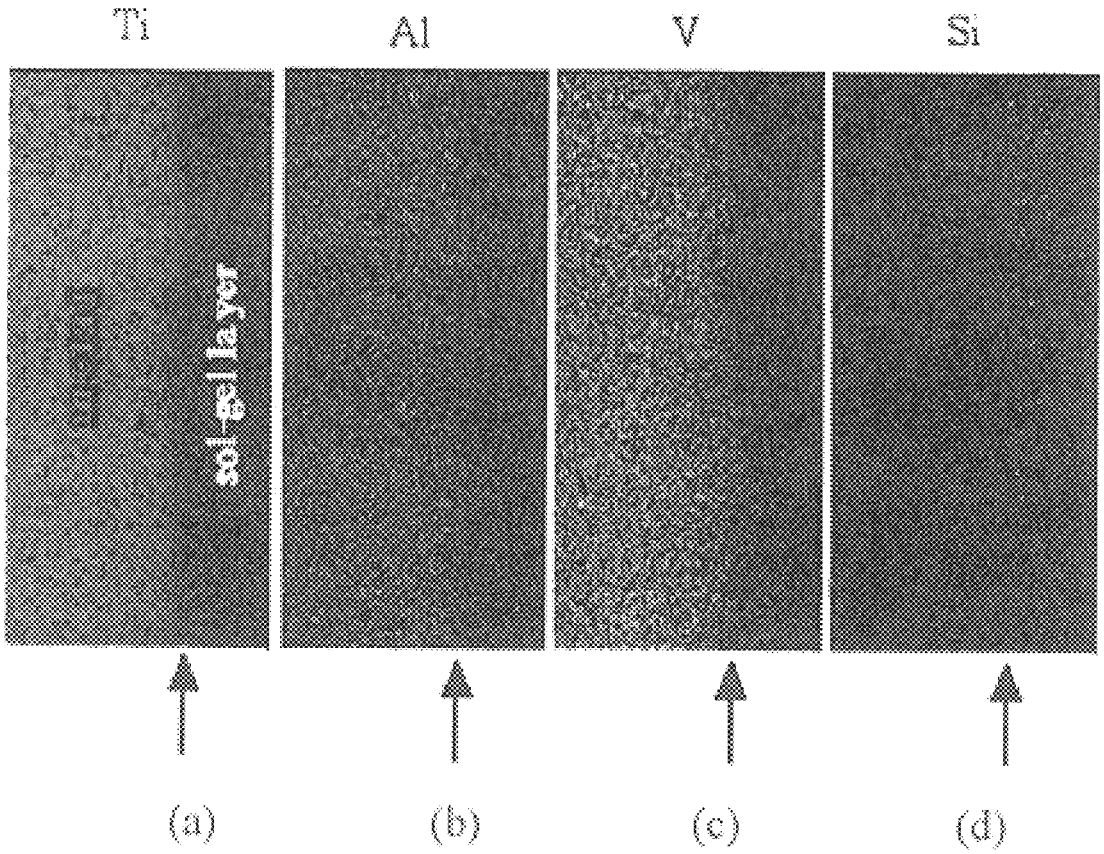
FIGS. 15*a*–*d* are x-ray maps of Ti-6-4 treated with the acid-base process of the present invention using a sol-gel solution, in which the arrows indicate the metal surface boundary.

AES depth profile revealed an oxygen peak at the interface between the metal and sol-gel layer, probably representing a fresh oxide layer developed during base treatment, and the thickness of the oxide layer was less than 200 nm based on the depth profile. This oxygen peak was also observed at an EDX line map of a metal treated by the alkaline perborate solution at RT for 10 min as shown in FIG. 14. The thickness of the oxide layer estimated the EDX map was approximately 150 nm, which corresponds with that from the AES analysis. X-ray mapping of a metal treated by an acid-base process (RT for 10 min) illustrated that the aluminum composition slightly increased while the titanium and vanadium vanished rapidly at the outermost metal surface. This is seen in FIGS. 15*a–d,* from which the interface of the Al map appeared distinct compared to the diffusive interfaces of the rest of the sample. This observation was further supported by EDX line mapping. It is speculated that an oxide layer developed by the alkaline perborate has aluminum compounds such as aluminum oxides, which may provide a more durable interface after being chemically bonded with silane groups of the sol-gel layer.

Lap shear strength and contact angles

Figure 16:
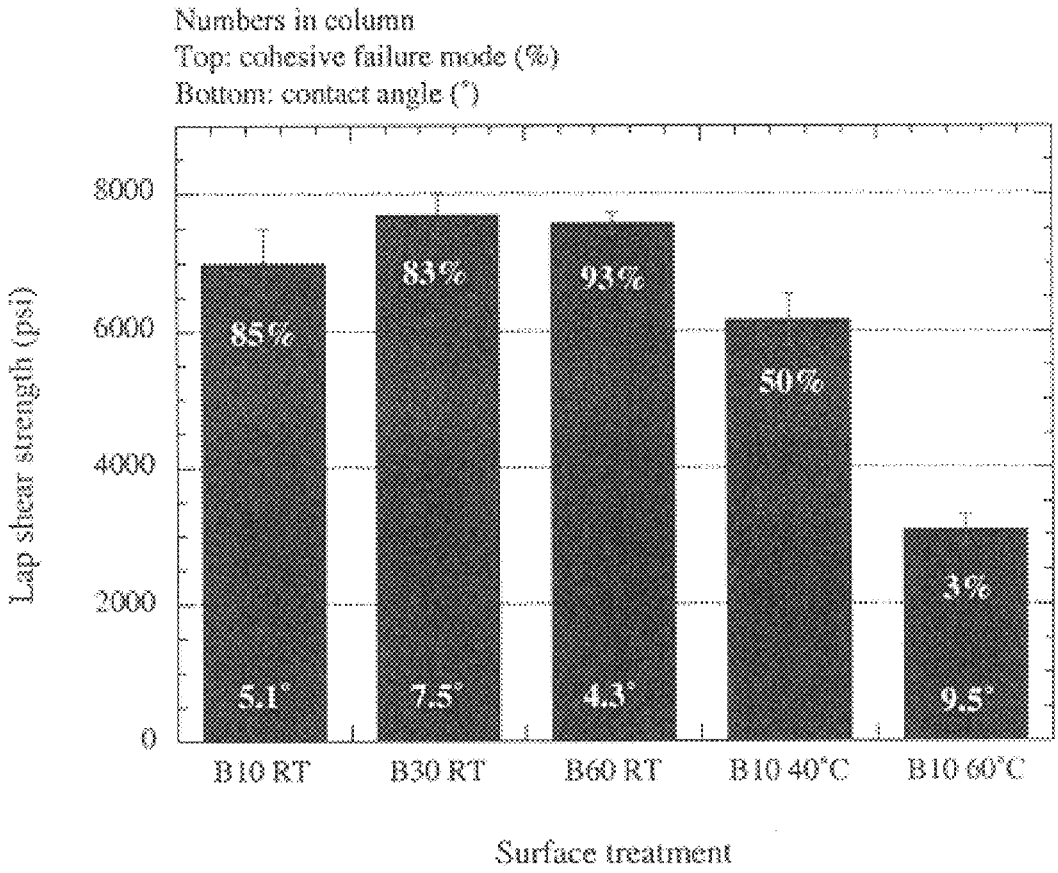
FIG. 16 is a graph of lap shear strength as a function of base treatment, where the cohesive failure mode (in %) is denoted at the top of each column and the contact angle is denoted at the bottom of each column.

Lap shear strengths of the specimens treated with various conditions were measured as a function of time and temperature (FIG. 16). The apparent cohesive failure modes (%) and the contact angles (°) measured by goniometer are shown as numbers in each column top and bottom, respectively. There is a good correlation between the lap shear strengths and contact angles. Base treated specimens at RT appeared to exhibit better strengths than those at an elevated temperature.

Surface treatment without acid (base only)

The surface pretreatment (alkaline perborate only) without acid etching was also performed for the aluminum alloy (2024-T3) using the 15% PETI-5·APEIS/TEOS primer/coupling agent at RT and 60° C. for 10 min, respectively. Single lap shear specimens were prepared with a press and tested. Both lap shear specimens treated with base at RT and 60° C. without acid showed comparable strengths (3148 and 3307 psi, respectively) to that with acid-base treatment (3314 psi), exhibiting cohesive metal failure.

Epoxy adhesive and epoxy primer

Non-phenylethynyl terminated imide based adhesives and primers were also used to evaluate the new surface treatment. The alkaline perborate treatment without acid etching was performed for aluminum alloy (2024T3) using a 15% BR127 epoxy based primer at RT for 10 min. Single lap shear specimens were prepared with FX-73 epoxy based adhesive using a press. Two sets of specimens showed average lap shear strengths of 4555 and 5390 psi with 100% apparent cohesive failure modes in the middle of the adhesive used.

TABLE 1

Lap shear strength (LSS) of three metal substrates treated at various conditions.

| Metal | Base treatment min, ° C. | Contact Angle | Primer | LSS (psi) at RT |
|---|---|---|---|---|
| Ti-6-4 | 10, RT | 5° | PAT* | 6934 ± 435 |
| Ti-6-4 | 30, RT | 8° | PAT | 7630 ± 334 |
| Ti-6-4 | 60, RT | 4° | PAT | 7514 ± 145 |
| Ti-6-4 | 10, 40 | 10° | PAT | 6107 ± 392 |
| Ti-6-4 | 10, 60 | 10° | PAT | 6107 ± 392 |
| Ti-6-4 | 10, RT | 5° | PETI-5 | 7601 ± 566 |
| Ti-6-4 | PasaJell 107 | | PAT | 6542 ± 232 |
| Ti-6-4 | PasaJell 107 | | PETI-5 | 7151 ± 276 |
| S-Steel | 10, RT | 45° | PAT | 2147 ± 73 |
| S-Steel | 10, 40 | 25° | PAT | 3655 ± 377 |
| Al alloy | 10, RT | 8° | PAT | 3298 |

*PAT:PETI-5/APEIS/TEOS

TABLE 2

Lap shear strengths of PAT after aging at 177° C.

| Time (hr) | 0 hr | 500 hr | 1000 hr | 2000 hr |
|---|---|---|---|---|
| LSS psi | 6162 ± 390 (50) | 6835 ± 362 (75) | 6027 ± 515 (53) | 5893 ± 855 (55) |

LSS: RT strength ± standard deviation, psi (cohesive failure mode, %)
Surface treatment: perborate

What is claimed is:

1. A method for treating the surface of a metal substrate, comprising the steps of:

providing a substrate, wherein the substrate is selected from the group consisting of titanium, Ti-6-4 alloy, shiny Ti-6-4 alloy, dark Ti-6-4 alloy, stainless steel, PH17-7 stainless steel, glass, and silicon wafer;

exposing the substrate to an acid, thereby forming a first treated substrate; and exposing the first treated substrate to an alkaline perborate solution, thereby forming a second treated substrate.

2. The method of claim 1, wherein the first treated substrate is subjected to ultrasonic washing with water prior to application of the alkaline perborate.

3. The method of claim 1, wherein the first treated substrate is exposed to the perborate solution for at least 10 minutes.

4. The method of claim 1, wherein the first treated substrate is exposed to the perborate solution for at least 30 minutes.

5. The method of claim 1, further comprising the step of applying an adhesive to the second treated substrate.

6. A method for treating the surface of a metal substrate, comprising the steps of:

providing a metal substrate comprising a titanium alloy;

etching a surface of the substrate with sulfuric acid, thereby forming a first treated surface; and oxidizing the first treated surface by exposing the first treated surface to an alkaline perborate solution, thereby forming a second treated surface.

7. The method of claim 6, wherein the first treated surface is exposed to an alkaline perborate solution at a temperature of at least 30° C. for at least about 30 minutes.

8. The method of claim 6, wherein the first treated surface is exposed to an alkaline perborate solution at a temperature of at least 60° C. for at least about 1 hour.

* * * * *